US009223290B2

(12) United States Patent
Aiba et al.

(10) Patent No.: US 9,223,290 B2
(45) Date of Patent: Dec. 29, 2015

(54) IMAGE FORMING APPARATUS

(71) Applicant: CANON KABUSHIKI KAISHA, Tokyo (JP)

(72) Inventors: Hirohiko Aiba, Suntou-gun (JP); Satoru Taniguchi, Mishima (JP); Jun Asami, Susono (JP); Takashi Honke, Mishima (JP); Masaki Hirose, Suntou-gun (JP); Shinkichi Yamamoto, Suntou-gun (JP); Yoshihiro Matsuo, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/670,294

(22) Filed: Mar. 26, 2015

(65) Prior Publication Data

US 2015/0277313 A1 Oct. 1, 2015

(30) Foreign Application Priority Data

Mar. 28, 2014 (JP) ..... 2014-069579

(51) Int. Cl.
*G03G 21/20* (2006.01)
*G03G 15/20* (2006.01)

(52) U.S. Cl.
CPC ..... *G03G 21/20* (2013.01); *G03G 15/2053* (2013.01); *G03G 21/206* (2013.01)

(58) Field of Classification Search
CPC ..... G03G 15/2053; G03G 15/0142; G03G 21/20; G03G 21/1609; G03G 21/206
USPC ..... 399/329, 91, 92
See application file for complete search history.

(56) References Cited

U.S. PATENT DOCUMENTS

| | | | | |
|---|---|---|---|---|
| 5,307,133 | A * | 4/1994 | Koshimizu | G03G 15/2064 399/92 |
| 8,355,647 | B2 * | 1/2013 | Ootsuka | G03G 21/206 399/91 |
| 8,750,746 | B2 * | 6/2014 | Tsuru | G03G 21/1609 399/92 |
| 2012/0002997 | A1 * | 1/2012 | Hiraoka | G03G 21/206 399/92 |

FOREIGN PATENT DOCUMENTS

| | | | |
|---|---|---|---|
| JP | 2002-221873 | A | 8/2002 |
| JP | 2004093587 | A | 3/2004 |
| JP | 2011-237555 | A | 11/2011 |
| JP | 2011252944 | A * | 12/2011 |

* cited by examiner

*Primary Examiner* — Susan Lee
(74) *Attorney, Agent, or Firm* — Canon USA Inc. IP Division

(57) ABSTRACT

An image forming apparatus that forms a toner image on a recording medium includes an image forming unit, a fixing unit, and an output unit. The fixing unit includes a heating member and a backup member. The backup member forms a nip with the heating member. The output unit, provided on a downstream side of the nip, outputs the recording medium to an outside of the apparatus. The recording medium is conveyed at the nip with a side of the recording medium facing the heating member set as an upper side of the recording medium.

5 Claims, 5 Drawing Sheets

IMAGE FORMING APPARATUS

BACKGROUND OF THE INVENTION

1. Field of the Invention

The present invention relates to an image forming apparatus equipped with a fixing unit.

2. Description of the Related Art

In general, an image forming apparatus utilizing the electrophotographic process forms an unfixed toner image on a recording medium with an image forming unit and heats and applies pressure to the unfixed toner image with a fixing unit so as to fix the unfixed toner image onto the recording medium.

Some types of toner used in the image forming apparatuses contain a releasing wax so as to produce effects such as adjustment of the gloss of an image formed on a recording medium and dispersibility of a pigment. The releasing wax is liquefied when the recording medium is heated and subjected to the pressure by the fixing unit. Although most of the liquefied releasing wax together with the fused toner is attached to the recording medium and solidified, part of the liquefied releasing wax is gasified. The gasified releasing wax may become fine particles in the liquid phase or the solid phase depending on the ambient temperature and may be attracted to members in a space through which the recording medium is conveyed while moving in the space with the recording medium. In particular, when the releasing wax is attracted to rollers that convey the recording medium on the downstream side of the fixing unit in a direction in which the recording medium is conveyed, the performance of conveying the recording medium may be degraded.

In order to address this, Japanese Patent Laid-Open No. 2011-237555 discloses a structure that includes a housing, a conveyance rotary member, and a closing member. The housing houses a heating rotary member and has an exit that is open on the downstream side in a recording medium conveyance direction, in which a transfer material is conveyed. The conveyance rotary member guides conveyance of the transfer material provided near the exit in the housing. The closing member closes a space between the housing and the transfer rotary member.

However, since it is required that a gap be provided between the closing member described in Japanese Patent Laid-Open No. 2011-237555 and a recording medium, part of a releasing wax component may move through the gap together with the recording medium toward the downstream side of a fixing unit in the recording medium conveyance direction and may be attracted to conveyance rollers. Accordingly, the present invention provides an image forming apparatus in which the releasing wax component is unlikely to be attracted to the conveyance rollers disposed downstream of the fixing unit in the recording medium conveyance direction.

SUMMARY OF THE INVENTION

According to an embodiment of the present invention, an image forming apparatus that forms a toner image on a recording medium includes an image forming unit, a fixing unit, and an output unit. The image forming unit forms the toner image on the recording medium. The fixing unit fixes the toner image on the recording medium by heating the toner image while conveying the recording medium bearing the toner image at a nip. The fixing unit includes a heating member and a backup member. The backup member forms the nip with the heating member. The output unit, provided on a downstream side of the nip in a conveyance direction of the recording medium, conveys the recording medium and outputs the recording medium to an outside of the apparatus. In the image forming apparatus, the recording medium is conveyed at the nip with a side of the recording medium facing the heating member set as an upper side of the recording medium. In the image forming apparatus, a partition is provided so as to vertically partition a space above the upper side of the recording medium conveyed at the nip on the downstream side of the nip in the conveyance direction, and an enclosed space, different from a space through which the recording medium passes while the recording medium is conveyed from the nip to the output unit, is provided above the partition. In the image forming apparatus, the partition has a first opening that allows a space below the partition to communicate with the enclosed space. In the image forming apparatus, the enclosed space is provided with a second opening that allows the enclosed space to communicate with an outside of the enclosed space, and the second opening is provided above the first opening.

Further features of the present invention will become apparent from the following description of exemplary embodiments with reference to the attached drawings.

DESCRIPTION OF THE EMBODIMENTS

A fixing unit and an image forming apparatus according to the present invention will be described in detail below with reference to the drawings.

First Embodiment

Figure 1:
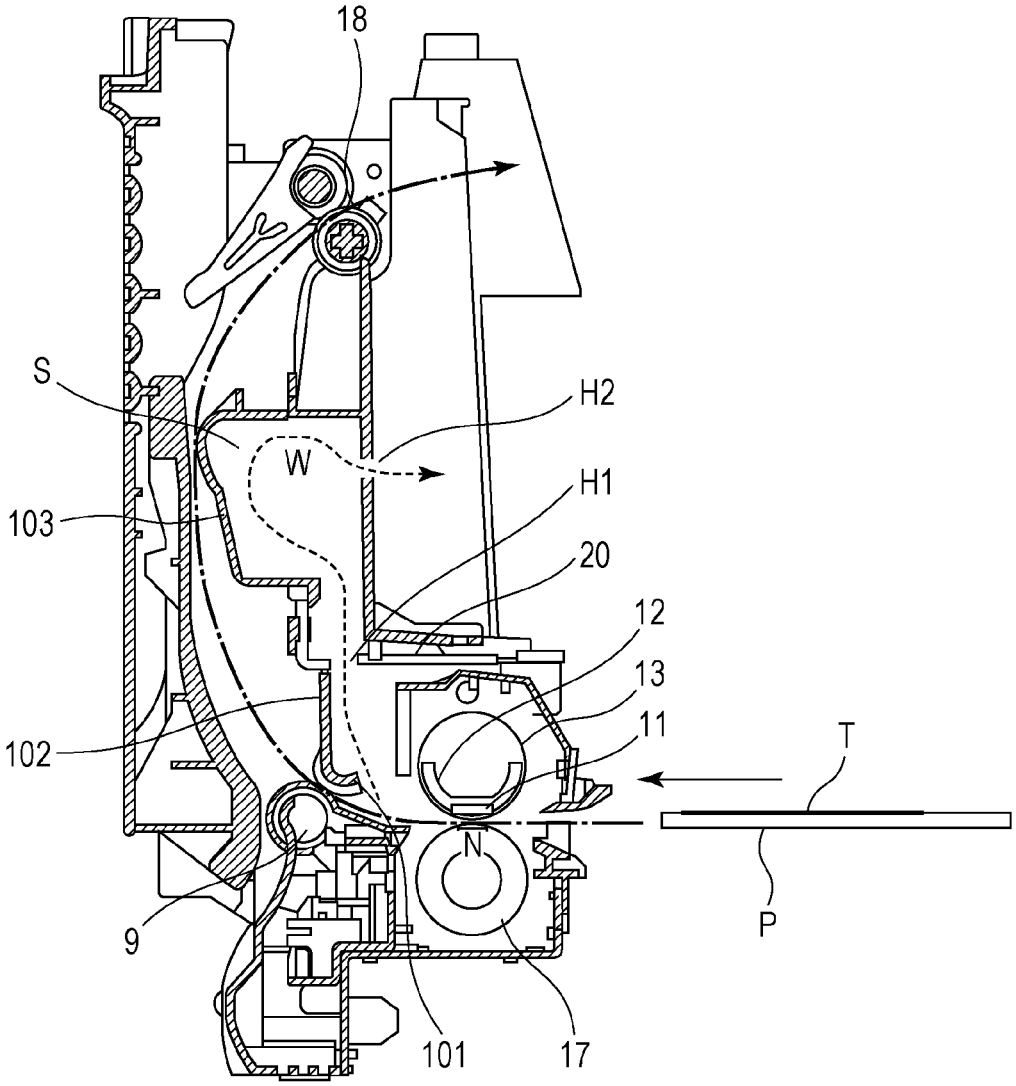
FIG. 1 is an enlarged schematic view illustrating part of an image forming apparatus according to a first embodiment from a fixing unit to an output unit.
Figure 2:
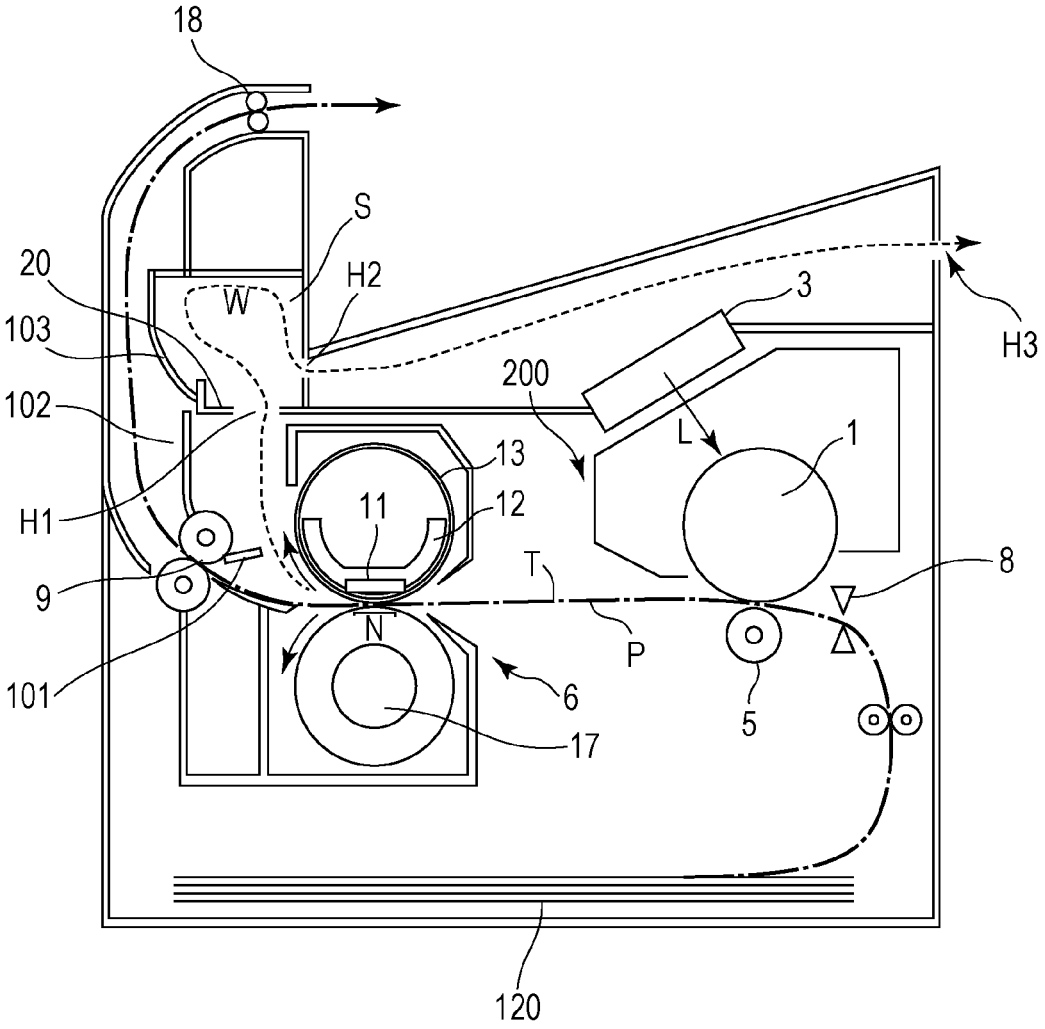
FIG. 2 is a schematic view of the image forming apparatus according to the first embodiment.
Figure 3:
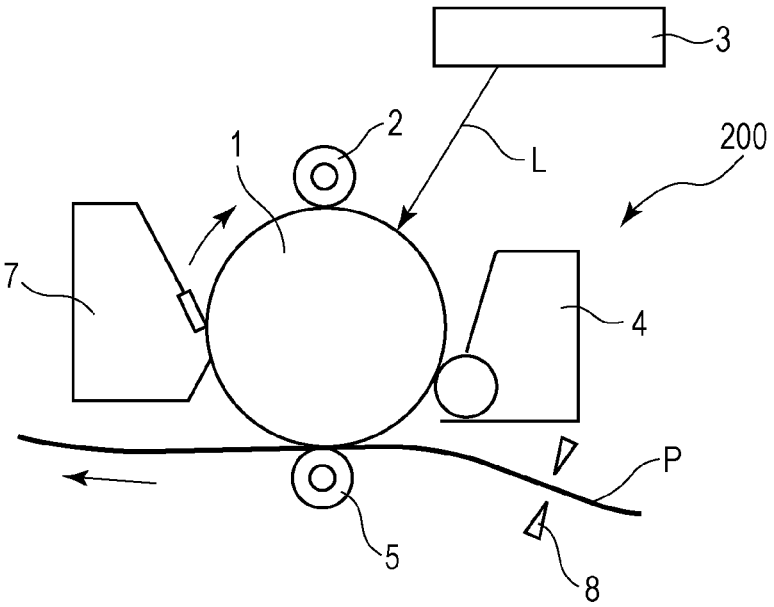
FIG. 3 is a schematic view of an image forming unit according to the first embodiment.

FIG. 2 is a schematic view of a laser beam printer serving as an image forming apparatus according to a first embodiment. FIG. 1 is an enlarged schematic view illustrating part of the laser beam printer according to the present embodiment from a fixing unit to an output unit. FIG. 3 is an enlarged schematic view of an image forming unit. In FIGS. 1 and 2, a dotted chain line indicates a conveyance path of a recording medium.

Initially, an image forming unit 200 according to the present embodiment is described with reference to FIG. 3. Reference numeral 1 denotes a photoconductor drum serving as an image carrying body. The photoconductor drum 1 is rotated clockwise, that is, in a direction indicated by an arrow, at a specified circumferential speed. Reference numeral 2 denotes a charger unit that includes a charging roller. The surface of the photoconductor drum 1 is uniformly charged to a specified polarity and a specified potential by the charger unit 2. Reference numeral 3 denotes a laser beam scanner. The laser beam scanner 3 outputs scanning exposure light L. The scanning exposure light L is controlled to be turned on and off in accordance with image information, so as to cause the charged surface of the photoconductor drum 1 to be subjected to scanning exposure. Charges on exposed bright portions of the surface of the photoconductor drum 1 are discharged by this scanning exposure, thereby an electrostatic latent image corresponding to the image information is formed on the surface of the photoconductor drum 1. This electrostatic latent image is developed and visualized as a toner image by a developing device 4. The visual toner image is transferred from the photoconductor drum 1 onto a recording medium P conveyed at specified timing by a transfer roller 5 serving as a transfer device.

Here, conveying of the recording medium P is described with reference to FIG. 2. The timing for conveying the recording medium P is determined by detecting a leading end of the recording medium P from a recording medium stacking unit 120 of the laser beam printer by a sensor 8 so that a leading end of the toner image on the photoconductor drum 1 matches a write start position at the leading end of the recording medium P. The recording medium P having been conveyed at the specified timing is conveyed through a transfer nip formed by the photoconductor drum 1 and the transfer roller 5. The recording medium P onto which the toner image has been transferred is conveyed to a fixing unit 6, by which the toner image is heat fixed onto the recording medium P. Meanwhile, residual toner not used for the transfer and remaining on the photoconductor drum 1 is removed from the surface of the photoconductor drum 1 by a cleaning device 7 illustrated in FIG. 3 so as to be repeatedly supplied for image formation.

Figure 4:
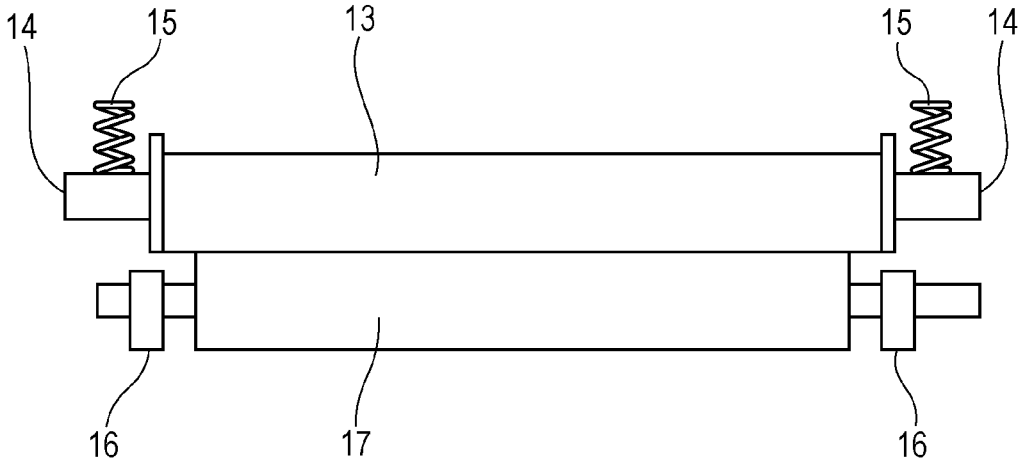
FIG. 4 is a schematic view illustrating a fixing film and a pressure roller of the image forming apparatus according to the first embodiment.

As illustrated in FIG. 2, the fixing unit 6 includes a fixing film 13, a heater 11, and a pressure roller 17. The fixing film 13 serves as a heating rotary member. The heater 11 is in contact with an inner surface of the fixing film 13. The pressure roller 17 serves as a backup member and forms a nip N together with the heater 11. The fixing unit 6 further includes a support member 12 that supports a surface of the heater 11 opposite to a surface of the heater in contact with the inner surface of the fixing film 13. The support member 12 also has the function of guiding the inner surface of the fixing film 13 through the contact thereof with the inner surface of the fixing film 13. Furthermore, as illustrated in FIG. 4, fixing flanges 14 are provided. The fixing flanges 14 serve as regulating members that regulate the movement of the fixing film 13 in the longitudinal direction. The fixing flanges 14 are attached to both end portions of the support member 12 in the longitudinal direction. The fixing film 13, the heater 11, the support member 12, and the fixing flanges 14 are parts of a film unit (heating member). As illustrated in FIG. 4, pressure springs 15 are in contact with the fixing flanges 14 so as to press the film unit against the pressure roller 17, thereby forming a fixing nip having a specified width. The heater 11 and the pressure roller 17 form the fixing nip N with the fixing film 13 interposed therebetween. Next, a drive structure of the fixing unit 6 is described. A shaft portion of the pressure roller 17 is supported by bearings 16. The pressure roller 17 is rotated by a drive force transmitted thereto from a drive source (not illustrated) through a drive member (not illustrated) or drive members (not illustrated) provided outside one of the bearings 16. As the pressure roller 17 is rotated, the fixing film 13 is rotated by a frictional force in the fixing nip N.

Next, a structure of the heater 11 is described. The heater 11 includes a substrate (not illustrated), a heat generating resistor (not illustrated), and a protective layer (not illustrated). The heat generating resistor is formed on the substrate. The protective layer is formed on the heat generating resistor. The substrate is formed of ceramic such as alumina (aluminum oxide) or aluminum nitride (AlN). The heat generating resistor is formed by printing a heat generating paste layer of silver palladium (Ag/Pd), $RuO_2$, $Ta_2N$, or the like on the substrate. The protective layer is formed of glass or the like having insulating properties. Power is supplied from a power supply unit (not illustrated) to the heat generating resistor on the heater 11 through a connector (not illustrated). A temperature detection element (not illustrated) that detects the temperature of the heater 11 is disposed on the surface of the heater 11 opposite to the surface of the heater 11 in contact with the fixing film 13. The power supplied to the heater 11 is controlled in accordance with the detection temperature of the temperature detection element.

The pressure roller 17 includes a metal core and a rubber layer formed outside the metal core. The metal core is formed of a metal such as stainless steel, free-cutting steel (SUM), or Al. The rubber layer is formed of a heat-resistant rubber such as silicone rubber or fluorocarbon rubber or by foaming silicone rubber. Furthermore, in order to improve release properties and wear resistance of the pressure roller 17, a surface layer may be formed of, for example, perfluoro alkoxy alkane (PFA), polytetrafluoroethylene (PTFE), or fluorinated ethylene propylene (FEP).

In the present embodiment, the pressure roller 17 includes the metal core formed of Al, the rubber layer formed of silicone rubber which is mixed with electrically conductive filler, and a releasing layer formed of PFA. The outer diameter of the pressure roller 17 is $\phi 30$. Furthermore, in order to stabilize conveyance properties of the recording medium, the pressure roller 17 has a 100 μm inversed crown shape.

The form of the backup member may be, for example, a rotating belt instead of the pressure roller 17 of the present embodiment.

The fixing film 13 is a flexible member and includes a base layer and a rubber layer provided outside the base layer. The base layer is formed of one of metal materials including stainless steel, Al, Ni, Cu, Zn, and so forth, or an alloy of one of these metal materials. From the viewpoint of quick start properties, the thickness of the base layer is preferably 200 μm or less. From the viewpoint of durability, the thickness of the base layer is preferably 20 μm or more.

Furthermore, in order to improve the releasing properties, a releasing layer may be formed of fluorocarbon resin such as PFA outside the rubber layer. The fixing film 13 of the present embodiment includes the base layer formed of stainless steel and having a thickness of 35 μm, the rubber layer formed of silicone rubber and having a thickness of 270 μm, and the releasing layer formed of PFA and having a thickness of 14 μm.

A conveyance path is described. Through the conveyance path, the recording medium P having undergone a fixing process in the fixing nip N is output to the outside of the apparatus with an output roller pair 18. The fixing film 13 is rotated by rotation of the pressure roller 17, and the power is supplied to the heater 11, thereby maintaining the temperature of the heater 11 at a temperature at which the fixing process can be performed (target temperature). The recording medium P on which an unfixed toner image T has been formed is conveyed through the fixing nip N while being heated and subjected to pressure. Thus the fixing process, in which the unfixed toner image T is fixed onto the recording medium P, is performed. The recording medium P is conveyed through the fixing nip N with a side thereof facing the fixing film 13 set as an upper side. The recording medium P having passed through the fixing nip N is, as illustrated in FIG. 1, guided to a conveyance roller pair 9 by a first guide unit 101. The conveyance roller pair 9 include a roller, which faces the side of the recording medium P in contact with the fixing film 13 and is rotated, and the other roller, which is rotated by the roller facing the side of the recording medium P in contact with the fixing film 13. The recording medium P having been conveyed by the conveyance roller pair 9 is fed to the output roller pair 18 (output unit) through a space formed by a second guide unit 102, a third guide unit 103, and so forth, and then output to the outside of the apparatus by the output roller pair 18. The first guide unit 101, the second guide unit 102, and the conveyance roller pair 9 are assembled (integrated) together.

Toner used in the present embodiment contains therein a releasing wax so as to produce effects such as adjustment of the gloss of an image formed on the recording medium P and dispersibility of a pigment. The releasing wax is moved from the inside to the outside of the toner when the toner is crushed by the pressure and heat in the fixing nip during conveyance of the recording medium P through the fixing nip N. The releasing wax exceeds the fusing point due to the heat in the fixing nip N and is converted into a liquid state or a gaseous state.

Figure 5B:
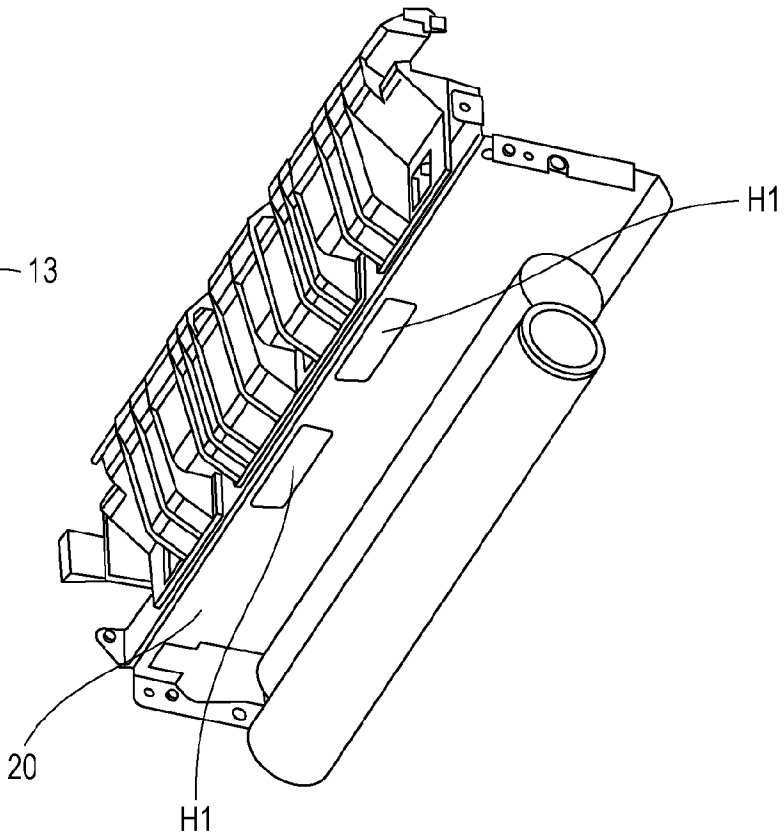
FIG. 5B illustrates the structure illustrated in FIG. 5A with the guide units removed.
Figure 5A:
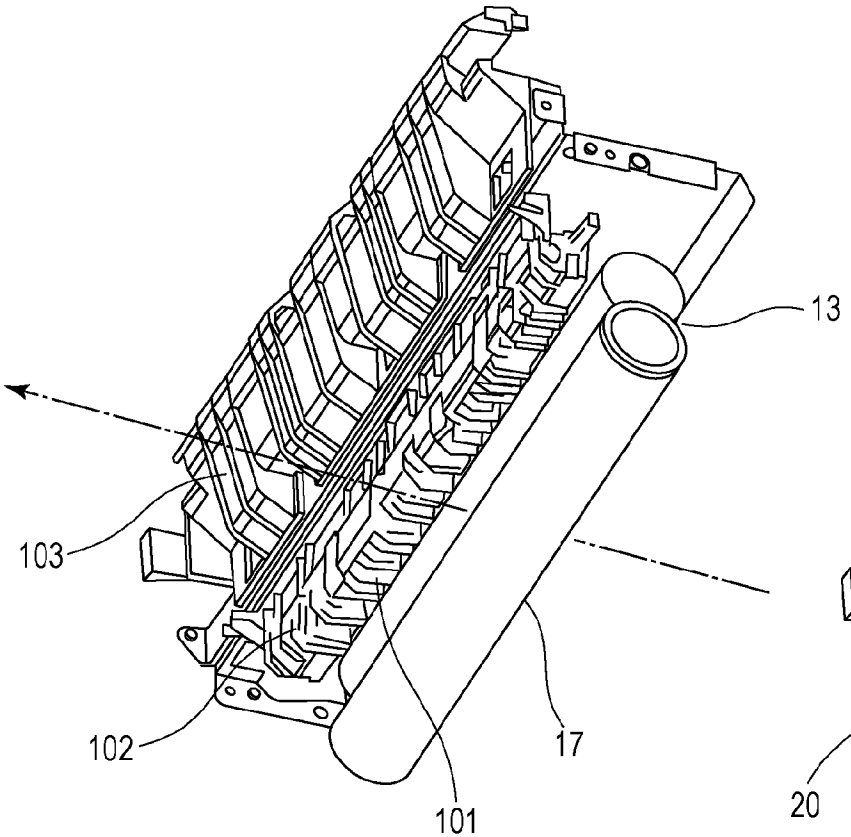
FIG. 5A illustrates the fixing film, the pressure roller, and guide units according to the first embodiment.

The present embodiment features a structure in which a gasified component of the releasing wax is unlikely to be attracted to conveyance rollers such as the output roller pair 18. Here, this structure is described. As illustrated in FIG. 1, a stay 20 is provided above the fixing unit 6. This stay 20 functions as not only as a frame of an apparatus main body but also a partition (first partition) that vertically partitions a space above the fixing unit 6. FIG. 5A is a perspective view illustrating the fixing film 13, the pressure roller 17, the first guide unit 101, the second guide unit 102, and the third guide unit 103. FIG. 5B is a perspective view illustrating the components illustrated in FIG. 5A with the guide units removed. As illustrated in FIG. 5B, the stay 20 has air vent holes H1 (first opening).

Next, the positions of the air vent holes H1 are described. The releasing wax having been converted into a liquid or gaseous state (gasified component) is generated from a side of the recording medium P on which a toner image is formed and likely to move to an upper side of the fixing unit 6 (near the fixing nip N) by an upward current generated from the heated recording medium P. Thus, the air vent holes H1 can be disposed above a region where the releasing wax is gasified. Specifically, this corresponds to a region from an exit of the fixing nip N to a position downstream of the fixing nip N in a recording medium P conveyance direction, in which the recording medium P is conveyed, the downstream position being a position where the toner temperature on the recording medium P becomes equal to or lower that the fusing point of the releasing wax. In a direction perpendicular to the recording medium P conveyance direction, the air vent holes H1 provided within a region where the toner image is formed are effective. In the present embodiment, a point where the toner temperature on the recording medium P becomes equal to or lower than the fusing point of the releasing wax is a position about 50 mm from a downstream end portion of the fixing nip N in the recording medium P conveyance direction. The detailed structure of the air vent holes H1 of the stay 20, which are provided at positions downstream of the fixing nip N in the recording medium P conveyance direction above the side of the recording medium P in contact with the fixing film 13 in the present embodiment is described. The air vent holes H1 of the present embodiment each have a width of 12 mm in the recording medium P conveyance direction and a width of 60 mm in the direction perpendicular to the recording medium P conveyance direction. Two air vent holes H1 are arranged in the direction perpendicular to the recording medium P conveyance direction.

Next, an enclosed space S provided above the stay 20 illustrated in FIG. 1 is described. The enclosed space S is formed by the third guide unit 103 and other components such as an apparatus frame. That is, the third guide unit 103 is one of members forming the enclosed space S. The enclosed space S is a space different from a space through which the recording medium P passes while the recording medium P is conveyed from the fixing nip N to the output roller pair 18. A space below the stay 20 communicates with the enclosed space S through the air vent holes H1. The enclosed space S is provided with an air vent hole H2 disposed above the air vent holes H1. The area of the air vent hole H2 is smaller than the total area of the air vent holes H1. Furthermore, as illustrated in FIG. 2, a gasified component W having passed through the air vent hole H2 is discharged to the outside of the apparatus through an air vent hole H3. As indicated by a dotted line in FIG. 1, the gasified component W of the releasing wax flows into the enclosed space S through the air vent holes H1 due to the upward current generated from the heated recording medium P at the exit of the fixing nip N. Since the enclosed space S is not provided with an opening having the area larger than the total area of the air vent holes H1 above the air vent holes H1, the gasified component W stays in the space and is attracted to the third guide unit 103 and so forth that form the enclosed space. Furthermore, the second guide unit 102 functions as a partition (second partition) for blocking a flow of the gasified component W toward the space through which the recording medium P passes while the recording medium P is conveyed to the output roller pair 18. Thus, the second guide unit 102 can be formed without a hole.

As has been described, according to the present embodiment, the amount of the gasified component W flowing into the space through which the recording medium P is passed while the recording medium P is conveyed from the fixing nip N to the output roller pair 18 is reduced. As a result, the amount of the gasified component W attracted to the output roller pair 18 is reduced, and accordingly, an effect of stabilizing output performance of the output roller pair 18 can be obtained. Furthermore, with the structure according to the present embodiment, in addition to the reduction of the amount of gasified component W attracted the output roller pair 18, an effect of reducing the amount of gasified component W attracted to the conveyance roller pair 9 can be obtained. In order to efficiently obtain these effects, the total area of the air vent holes provided in the stay 20 is preferably equal to or larger than 500 $mm^2$. Furthermore, in order to cause the gasified component W to stay in the enclosed space S, it is required that the volume of the enclosed space S be equal to or larger than 100 $cm^3$. However, an excessive increase in the volume of the enclosed space S does not lead to changes in the effects corresponding to the increase in the volume but leads to an increase in the size of the apparatus. Thus, the volume of the enclosed space S is preferably equal to or less than 3000 $cm^3$.

The effects of the present embodiment were confirmed in an experiment. The result of the experiment is described next. The occurrence of a conveyance defect caused by attracting the gasified component W of the releasing wax to the output roller pair 18 in the laser beam printer of the present embodiment illustrated in FIG. 2 was compared with that in a laser beam printer of a comparative example. The structure of the laser beam printer of the comparative example was the same as that of the present embodiment except for the following:

that is, in the laser beam printer of the comparative example, the air vent holes H1, the enclosed space S, and the second guide unit 102 of the present embodiment were not provided. The experiment was performed under the following conditions: that is, the conveyance speed of the recording medium was set to 350 mm/sec in the laser beam printer, the life of which is 225,000 sheets of the recording medium; A4 size plain paper was used as the recording medium; and an image pattern of the printing ratio of 4% was used. As a result of the experiment, a conveyance defect occurred in the output roller pair 18 of the laser beam printer of the comparative example after about 200,000 sheets had been passed. In contrast, the laser beam printer of the present embodiment successfully allowed 225,000 sheets, which is the life of the apparatus, to pass therethrough without the occurrence of a conveyance defect.

From the above description, with the structure of the present embodiment, the effect of suppressing the attraction of the gasified component of the releasing wax generated from the toner heated in the fixing nip to the output roller pair can be obtained.

Although the stay 20 functions as the first partition in the present embodiment, the same effects can be obtained with a separate partition provided independently of the stay 20. Although the second guide unit 102 functions as the second partition in the present embodiment, the same effects can be obtained with a separate partition provided independently of the second guide unit 102 and does not have the guiding function. The second partition is provided so as to further increase the effects of the present invention. The effects of the present invention can also be obtained with a structure that does not include the second partition. Furthermore, the air vent hole H3 is not necessarily provided in the present invention.

Figure 6:
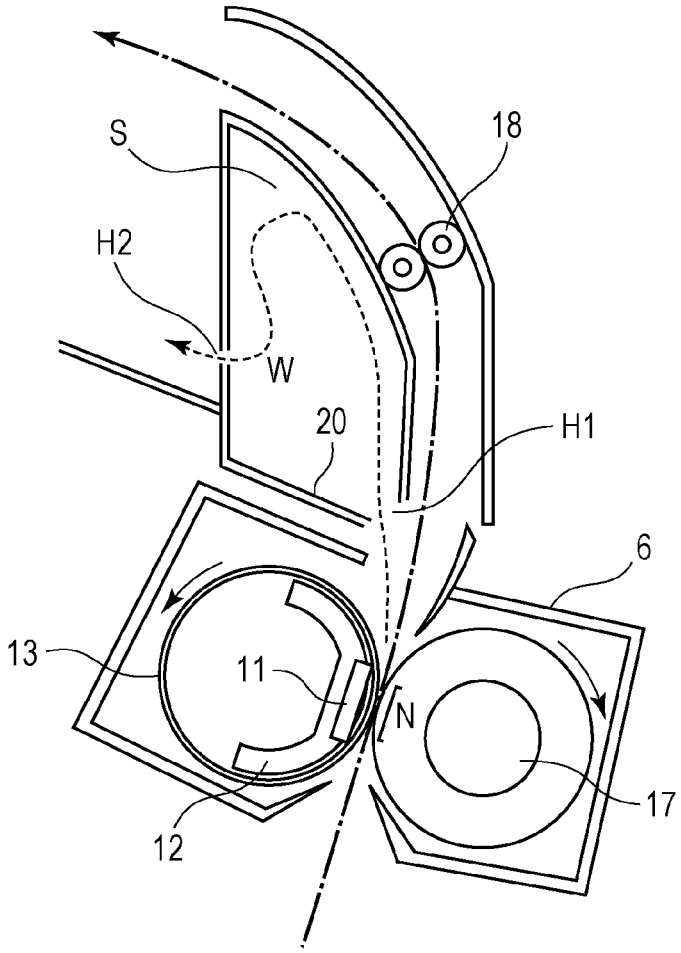
FIG. 6 is an enlarged schematic view illustrating part of the image forming apparatus according to a variant of the first embodiment from the fixing unit to the output unit.

FIG. 6 illustrates the image forming apparatus in which the recording medium conveyance direction extends in a vertical direction in the fixing unit as a variant of the first embodiment. Also with this image forming apparatus, the similar or the same effects can be obtained by an air vent hole H4 and the enclosed space S.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-069579 filed Mar. 28, 2014, which is hereby incorporated by reference herein in its entirety.

What is claimed is:

1. An image forming apparatus that forms a toner image on a recording medium, the apparatus comprising:

an image forming unit that forms the toner image on the recording medium;

a fixing unit that fixes the toner image on the recording medium by heating the toner image while conveying the recording medium bearing the toner image at a nip, the fixing unit including a heating member, and a backup member that forms the nip with the heating member; and an output unit, provided on a downstream side of the nip in a conveyance direction of the recording medium, that conveys the recoding medium and outputs the recording medium to an outside of the apparatus, wherein the recording medium is conveyed at the nip with a side of the recording medium facing the heating member set as an upper side of the recording medium, wherein a partition is provided so as to vertically partition a space above the upper side of the recording medium conveyed at the nip on the downstream side of the nip in the conveyance direction, and an enclosed space, different from a space through which the recording medium passes while the recording medium is conveyed from the nip to the output unit, is provided above the partition, wherein the partition has a first opening that allows a space below the partition to communicate with the enclosed space, and wherein the enclosed space is provided with a second opening that allows the enclosed space to communicate with an outside of the enclosed space, and the second opening is provided above the first opening.

2. The apparatus according to claim 1, wherein the partition is a first partition, and wherein a second partition is provided so as to extend from a position above the side of the recording medium facing the heating member toward the first partition on the downstream side of the first opening in the conveyance direction.

3. The apparatus according to claim 1, further comprising:

a guide member that guides the side of the recording medium facing the heating member while the recording medium is conveyed from the nip to the output unit, wherein the enclosed space is formed on a side of the guide member opposite to a side where the recording medium is conveyed.

4. The apparatus according to claim 3, wherein the guide member is one of members that form the enclosed space.

5. The apparatus according to claim 2, further comprising:

a conveyance roller that is provided between the nip and the output unit and that conveys the recording medium having passed through the nip to the output unit, wherein the second partition is integrally formed with a second guide member that guides the recording medium so as to direct the recording medium toward the conveyance roller.

* * * * *